US006406557B1

(12) United States Patent
Fortunati et al.

(10) Patent No.: US 6,406,557 B1
(45) **Date of Patent: *Jun. 18, 2002**

(54) PROCESS FOR THE TREATMENT OF GRAIN ORIENTED SILICON STEEL

(75) Inventors: Stefano Fortunati, Ardea; Stefano Cicale' , Rome; Giuseppe Abbruzzese, Montecastrilli; Susanna Matera, Rome, all of (IT)

(73) Assignee: Acciai Speciali Terni S.p.A., Terni (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/331,273

(22) PCT Filed: Jul. 24, 1997

(86) PCT No.: PCT/EP97/04009

§ 371 (c)(1),
(2), (4) Date: Jun. 17, 1999

(87) PCT Pub. No.: WO98/28453

PCT Pub. Date: Jul. 2, 1998

(30) Foreign Application Priority Data

Dec. 24, 1996 (IT) ..... RM96A0903

(51) Int. Cl.[7] ..... H01F 1/04; C21D 8/12

(52) U.S. Cl. ..... 148/111; 148/112; 148/221; 148/230; 148/232

(58) Field of Search ..... 148/221, 230, 148/232, 111, 112

(56) References Cited

U.S. PATENT DOCUMENTS

| | | | | | |
|---|---|---|---|---|---|
| 5,266,129 | A | * | 11/1993 | Minakuchi et al. | 148/113 |
| 5,472,521 | A | * | 12/1995 | Yoshitomi et al. | 148/111 |
| 5,507,883 | A | * | 4/1996 | Tanaka et al. | 148/113 |
| 5,512,110 | A | * | 4/1996 | Yoshitomi et al. | 148/113 |
| 5,597,424 | A | * | 1/1997 | Yoshitomi et al. | 148/111 |
| 5,643,370 | A | * | 7/1997 | Huppi | 148/111 |
| 5,679,178 | A | * | 10/1997 | Komatsubara et al. | 148/113 |
| 5,759,293 | A | * | 6/1998 | Takahashi et al. | 148/111 |
| 5,759,294 | A | * | 6/1998 | Bolling et al. | 148/111 |
| 5,800,633 | A | * | 9/1998 | Inokuti | 148/111 |
| 5,885,371 | A | * | 3/1999 | Komatsubara et al. | 148/113 |

* cited by examiner

*Primary Examiner*—Roy King
*Assistant Examiner*—Nicole Coy
(74) *Attorney, Agent, or Firm*—Hedman & Costigan, P.C.

(57) ABSTRACT

During the treatment of electrical steel, a careful combination of heat treatment of the slab with a specific primary recrystallization and nitriding treatment allows for control of the distribution, quantity and dimensions of precipitates in order to obtain a homogeneous precipitation of nitrogen compounds by direct reaction of the absorbed nitrogen with aluminum during the nitriding step.

10 Claims, 10 Drawing Sheets

PROCESS FOR THE TREATMENT OF GRAIN ORIENTED SILICON STEEL

The present application is the national stage filing of and claims priority to International Application No. PCT/EP97/04009, filed Jul. 24, 1997 and Italian Application Serial No. RM96A000903, filed Jul. 24, 1996.

FIELD OF THE INVENTION

The present invention relates to a process for the treatment of silicon steel; in particular it relates to a process for transforming a sheet of grain oriented silicon steel, wherein an initial controlled amount of precipitates (sulfides and aluminum as nitride) is produced in the hot-rolled strip in a fine and uniformly distributed form, suitable for the control of the grain size during decarburization annealing; the control of the subsequent secondary recrystallisation is obtained by adding to the initial precipitates further aluminum as nitride, directly obtained in a continuous high-temperature treatment.

STATE OF THE ART

Grain oriented silicon steel for electrical applications is generally classified into two categories, basically differing in the level of induction, measured under the influence of a magnetic field of 800 As/m, this parameter being indicated as 'B800'. Conventional grain oriented steels have B800 levels lower than 1890 mT; high-permeability grain oriented steels have B800 higher than 1900 mT. Further subdivisions have been made according to the so-called core losses, expressed in W/kg.

The conventional grain oriented steel, introduced in the thirties and the super-oriented grain steel, industrially introduced in the second half of the sixties, are essentially used for the production of cores of electric transformers, the advantages of the super-oriented grain product being its higher permeability, allowing cores of lower dimensions, and its lesser losses, allowing energy saving.

The permeability of electrical steel sheets is a function of the orientation of the cubic, body-centred iron crystals (grains); the best theoretical orientation is the one showing one corner of the cube parallel to the rolling direction.

Certain suitably precipitated products (inhibitors) called second phases, reduce the mobility of the grain boundary. Their use allows to obtain the selective growth of grains having the desired orientation; the higher the dissolution temperature in the steel of these precipitates, the higher the uniformity of orientation, the better the magnetic features of the end product. In the oriented grain, the inhibitor consists essentially of manganese sulfides and/or selenides, whereas in the super-oriented grain the inhibition is produced by a number of precipitates comprising said sulfides and aluminum as nitride, also in a mixture with other elements, from now on being referred to as aluminum nitride.

Nevertheless, in the production of the grain oriented and grain super-oriented steel, during solidification of the liquid steel and cooling of resulting solid, the inhibitors are precipitated in a coarse form, unsuitable for the desired purposes; therefore they must be dissolved and reprecipitated in the correct form, and so maintained until the grain having the desired dimensions and orientation is obtained at the stage of final annealing, after the cold rolling to the desired thickness and the decarburization annealing, i.e. at the end of a complex and costly transformation process.

Clearly the production problems, essentially due to the difficulty of obtaining good yields and constant quality, are mainly due to the measures to be taken for maintaining the inhibitors in the required form and distribution during the whole steel transformation process. In the case of the super-oriented product, a new technology has been developed in order to overcome these problems, as described e.g. in U.S. Pat. No. 4,225,366 and in EP 339474; these documents show the production of the aluminum nitride suitable for controlling the grain growth, by nitriding the strip preferably after the cold rolling step.

In the latter patent, aluminum nitride, precipitated in a coarse form during the slow solidification and the following cooling of the steel, is kept in this state by using low heating temperatures of the thick stab (lower than 1280° C., preferably lower than 1250° C.) before the hot rolling step; after the decarburization annealing, nitrogen is introduced in the sheet (essentially in proximity of its faces); it then reacts by producing silicon- and manganese-silicon nitrides having a relatively low solubilization temperature, which are dissolved during the heating phase in the final box-annealing. Nitrogen released in this manner can now deeply penetrate the sheet and react with aluminum, reprecipitating in a fine and homogeneous form along the whole thickness of the strip in the form of mixed alluminum and silicon nitride; this process requires the permanence of the material at 700–800° C. for at least four hours. In cited EP patent it is stated that the temperature of nitrogen introduction must be close to the decarburization temperature (about 850° C.), and in any case not higher than 900° C., in order to avoid an uncontrolled grain growth, given the absence of suitable inhibitors. In fact, the optimal nitriding temperature appears to be 750° C., whereas 850° C. represents the upper limit to avoid such uncontrolled growth.

This process seems to comprise certain advantages, such as the relatively low heating temperature of the slab before the hot rolling step, or the relatively low decarburization and nitriding temperatures; another advantage lies in the fact that there is no increase in production costs in maintaining the strip in the box-annealing furnace at 700–800° C. for at least four hours (with the purpose of obtaining the mixed aluminum and silicon nitrides necessary for a controlled grain growth), because the time required for heating the box annealing furnaces is approximately the same.

However the above cited advantages are associated to some disadvantages, among which: (i) the almost total lack of precipitates inhibiting the grain growth, due to the low heating temperature of the slab; as a consequence, any heating of the strip, i.e. during the decarburization and nitriding processes, has to be performed at relatively low and critically controlled temperatures, in order to prevent an uncontrolled grain growth under the above referred conditions; (ii) the impossibility of taking any measures during the final annealing step, in order to accelerate the heating time, e.g. by replacing the box-annealing furnaces with other furnaces operating in continuous.

DESCRIPTION OF THE INVENTION

The present invention aims at overcoming the disadvantages of the known production systems, by proposing a new process allowing the control within optimal limits of the size of the grain of primary crystallisation and, at the same time, allowing to perform a high-temperature nitriding reaction enabling the correction of the total useful inhibition content, up to the necessary values, directly during continuous annealing.

According to the invention, the continuously cast slab is heated at a temperature sufficient to dissolve a limited but significant amount of second phases like sulfides and nitrides, which are thereafter reprecipitated in a way suitable to control the grain growth up to the decarburization annealing, included. In the course of a further high-temperature treatment during the same continuous annealing, further aluminum-bonded nitrogen is precipitated, in order to adapt the total amount of second phases to the desired grain orientation during the secondary recrystallisation.

The present invention relates to a process for the production of an electrical steel sheet, wherein a silicon steel is continuously cast, hot-rolled and cold-rolled, and wherein the obtained cold strip is annealed in continuous in order to perform primary recrystallisation, decarburization, and thereafter (still under continuous conditions) nitriding, coated with an annealing separator, and box-annealed in order to perform a final secondary crystallisation treatment, said process being characterised by the combination in cooperation relationship of the following steps:

(i) producing a hot-rolled sheet in which the inhibition level (Iz) necessary to control the grain growth, calculated according to the empiric formula:

$$Iz=1.91\ Fv/r$$

(where Fv is the volumetric fraction of the useful precipitates and r is their mean radius) is comprised between 400 and 1300 cm−1; this can be done for instance by performing an equalising thermic treatment onto the continuously cast steel at a temperature comprised between 1100 and 1320° C., preferably between 1270 and 1310° C., followed by hot-rolling under controlled conditions;

(ii) performing a continuous primary recrystallisation annealing of the cold-rolled strip at a temperature comprised between 800 and 950° C., in a wet nitrogen-hydrogen atmosphere, said annealing optionally comprising a decarburization step;

(iii) performing under continuous conditions a nitriding annealing step at a temperature comprised between 850 and 1050° C., for a time comprised between 5 and 120 s, by introducing in a nitriding area of the furnace some nitriding, preferably $NH_3$containing gas in a quantity of between 1 and 35 normal liters per kg of treated strip, together with steam in a quantity between 0.5 and 100 g/m3, the $NH_3$ content of said gas preferably being comprised between 1 and 9 normal liters per Kg of treated steel.

According to the present invention, it is also possible to remarkably increase, during the next secondary recrystallisation treatment, the heating rate within the temperature range of 700 to 1200° C., thereby reducing the heating time from the conventional 25 hours or more, necessary according to the known processes, to less than four hours; interestingly, this is the same temperature range as critically required by the known processes in order to dissolve the silicon nitride formed on the surface, to diffuse the released nitrogen into the sheet, and to form a precipitate consisting of mixed alluminum nitrides, such process requiring, according to the known teachings, at least four hours at a temperature comprised between 700 and 800° C.

As far as the steel composition is concerned, alluminum should suitably be present in the range of 150 to 450 ppm.

Besides, it should be noted that it is not necessary to perform the nitriding treatment after the primary recrystallisation: it may also be performed during other steps of the transformation process of the laminate after the cold-rolling step.

Of course, the remaining part of the transformation cycle is performed according to specific modalities depending on the desired final product; these modalities will not be referred to in the description, unless when necessary for exemplification purpose.

The present invention allows, independently from the desired end product, to operate under no tight temperature control, and yet to obtain, in primary recrystallisation, a grain with optimal dimensions for the final quality; it also allows to obtain the direct high-temperature precipitation of aluminum as nitride during the nitriding annealing step.

The basis of the present invention can explained as follows. It is deemed necessary to maintain a certain amount of inhibitor in the steel up to the continuous nitriding annealing step; this amount should not be negligeable, and should be suitable to control the grain growth, thereby allowing to work at relatively high temperatures, avoiding at the same time the risk of an uncontrolled grain growth, with severe shortfalls in yields and magnetic qualities.

This can be obtained in several ways along the production cycle preceding the cold rolling step, for example by combining (a) a precise choice of composition elements necessary for the precipitation of sulfides, selenides, and nitrides, such as S, Se, N, Mn, Cu, Cr, Ti, V, Nb, B, etc., and/or elements which, when present in solid solution, may affect the movement of the grain boundary during the thermic treatments, such as Sn, Sb, Bi, etc. together with (b) the employed type and modality of casting, the temperature of the cast bodies before the hot rolling step, the temperature of the hot rolling step itself, the thermic cycle of the hot-rolled strips possible hot annealing.

Independently from their method of production, the final strips must show a useful inhibition content within a well defined range: on the basis of extensive experimentation performed in laboratory as well as on industrial plants, the present inventors have defined this range as being comprised between 400 and 1300 cm−1 (as shown in Example 1 below).

During said experiments it was also found that the total inhibition value allowing to obtain the best magnetic features depends, case by case, on the grain size distribution developed during primary recrystallisation: the higher the grain mean size and the lower the standard deviation of the size distribution, the lower the inhibition level necessary for the grain control.

In the specific case of the present invention, the control of precipitates is obtained by maintaining the slab temperature high enough to solubilize a significant amount of inhibitors, but at the same time low enough to prevent the formation of liquid slag, thereby avoiding the need for expensive special furnaces.

The inhibitors, once finely reprecipitated after the hot-rolling process, allow to avoid an extended control of the treatment temperatures; they also allow to increase the nitriding temperature up to the level necessary for the direct precipitation of aluminum as nitride, and to increase the rate of nitrogen penetration and diffusion into the sheet.

The second phases present in the matrix work as nuclei for said precipitation induced by the nitrogen diffusion, also allowing to obtain a more uniform distribution of the absorbed nitrogen along the sheet thickness.

DESCRIPTION OF THE DRAWINGS

The process according to the present invention is now illustrated in the following examples and drawing sheets in a mere exemplificative non limitative manner.

EXAMPLE 1

Figure 1:
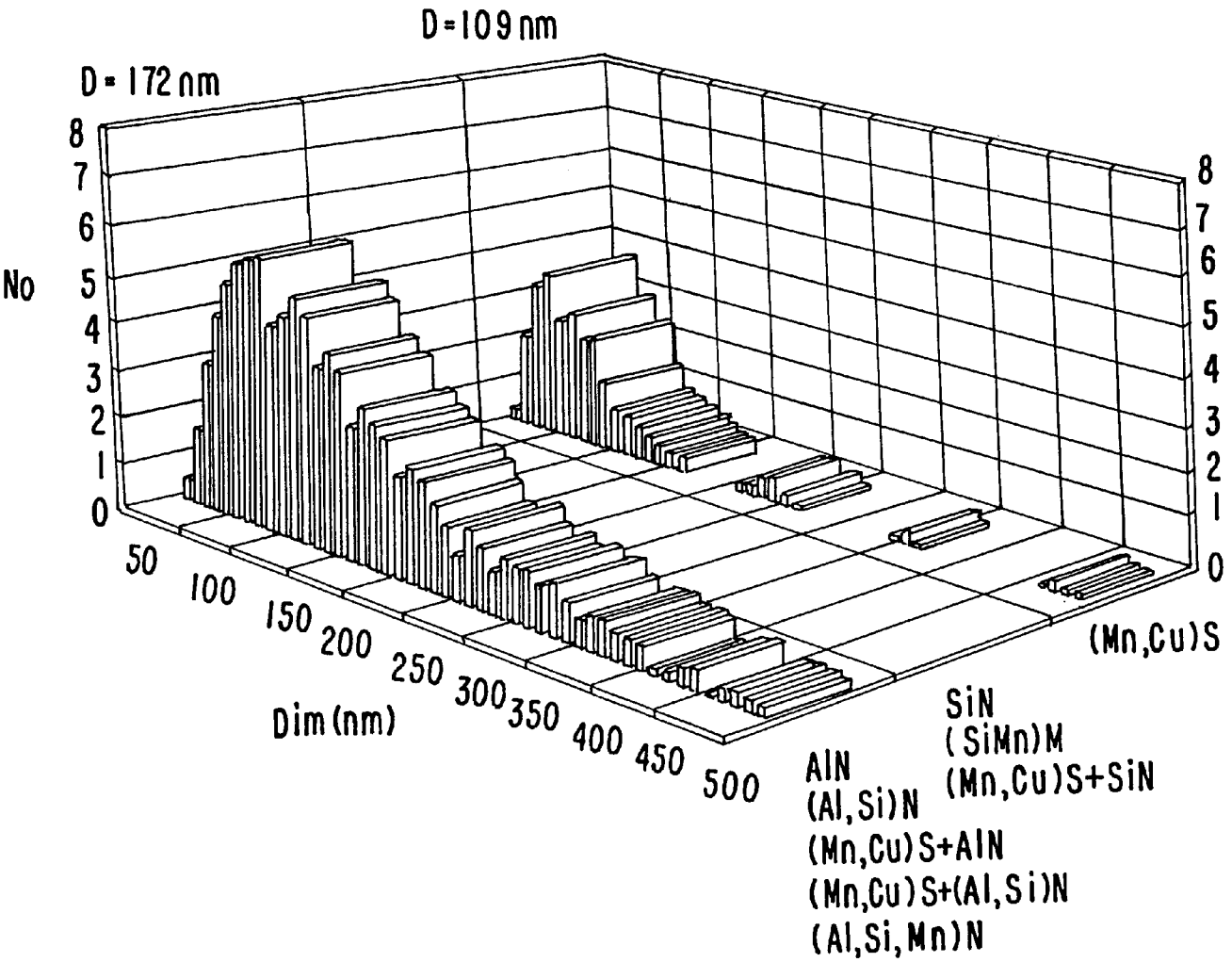
FIG. 1 is a tridimensional diagram for a typical decarburized strip, wherein the following data are shown: (i) x axis: type of precipitates; (ii) y axis: size distribution of said precipitates; (III) z axis: the percentage of occurrence of the precipitates according to the relative dimensions; the mean radius of the different groups of precipitates is represented as 'D', above the x-z plane.

In order to assess the effect of the inhibition occurring before the nitriding step, a number of single stage cold rolled steel sheets differing in composition and/or casting conditions and/or slab heating temperature and/or hot rolling conditions, were treated according to an entirely industrial cycle as well as a mixed industrial-laboratory cycle.

The inhibition was assessed according to the known empiric formula:

$$Iz=1.91\ Fv/r$$

where Iz is a value in cm−1 representing the inhibition level, Fv is the volumetric fraction of the useful precipitates evaluated for chemical analysis, and r is the mean radius of the precipitate particles, evaluated by counting the precipitates at the microscope, on the basis of 300 particles per sample.

Further assessment was made of the grain equivalent radius (Deq) after decarburization annealing and primary recrystallisation, as well as after the nitriding step; the standard deviation E of the measurements distribution was also calculated. The transformation cycle was completed by box annealing under standard conditions (progressive heating up to 1200° C. at a heating rate of 20° C./h, and maintenance of such temperature for 20 hours)

The results are reported in Table 1.

TABLE 1

| Sample | $Iz^{(cm-1)}$ | Decarburation Deq, 850° C. 180 s | E | Nitriding Deq, 970° C. 30 s | E | B800 (mT) |
|---|---|---|---|---|---|---|
| a | 188 | 27.1 | 0.50 | 37.0 | 0.62 | 1540 |
| b | 250 | 25.6 | 0.48 | 34.2 | 0.59 | 1620 |
| c | 440 | 23.5 | 0.53 | 27.4 | 0.58 | 1870 |
| d | 660 | 22.2 | 0.52 | 26.0 | 0.54 | 1940 |
| e | 830 | 18.3 | 0.53 | 24.0 | 0.53 | 1910 |
| f | 620 | 24.0 | 0.49 | 28.4 | 0.53 | 1940 |
| g | 1015 | 15.3 | 0.51 | 20.2 | 0.52 | 1890 |
| h | 1420 | 12.0 | 0.48 | 30.1 | 0.75 | 1550 |
| i | 2700 | 8.2 | 0.44 | 11.2 | 0.61 | 1830 |
| j | 2010 | 9.5 | 0.45 | 13.2 | 0.65 | 1580 |

From the results reported in this table, as well as from further experimentation, it can be observed that a correct inhibition for the purpose of the present invention is present within a range of values comprised between 400 and 1300 $cm^{-1}$.

EXAMPLE 2

In order to verify the effectiveness of the penetrating nitriding process performed at high temperature according to the present invention, a silicon steel (comprising Si 3.05% by weight, Al(s) 320 ppm, Mn 750 ppm, S 70 ppm, C 400 ppm, N 75 ppm, Cu 1000 ppm) was cast in a continuous thin casting machine (slab thickness 60 mm); the slabs were heated at 1230° C. and hot-rolled; the hot-rolled strip was annealed at a maximum temperature of 1100° C., and cold-rolled to a thickness of 0.25 mm. The cold-rolled strip was decarburized at 850° C. and then nitrided under different conditions of temperature and composition of nitriding atmosphere ($NH_3$ content).

The strips thus obtained were then divided into two groups and alternatively treated according to one of the two box annealing cycles as reported in Table 2.

The following tables 3, 4, and 5 summarise the results obtained, according to the present invention, on the previously described product containing 120 initial ppm of Al as nitride; in particular, column 1 specifies the nitriding temperatures; column 2 indicates the amount (ppm) of nitrogen added to the strip (Ni); column 3 shows the total amount of aluminum measured as nitride (AlN) after the treatments; column 4 indicates the amount of AlN precipitated after the nitriding treatment; column 5 shows the amount of nitrogen added to the central part of the sheet (Nc), measured peeling away 25% of the sheet thickness on each face; column 6 reports the mean radius (D), measured in microns, of the primary recrystallisation grain; columns 7 and 8 indicate respectively the magnetic permeability of strips produced according to cycles A and B of Table 1.

TABLE 2

| Cycle | Heating time at 750° C. $H_2/N_2$ (3:1) with 20 g/l $H_2O$ | Heating time from 750° to 1200° C. $H_2/N_2$ (3:1) | Maintenance time at 1200° C. (100% $H_2$) | Cooling time from 1200° C. to 800° C. |
|---|---|---|---|---|
| A | 10 hours | 35 hours | 20 hours | 4 hours |
| B | 10 hours | 2.5 hours | 20 hours | 4 hours |

TABLE 3

(low nitriding power)

| Nitriding temp. ° C. | $N_i$ | AlN | $AlN_n$ | $N_c$ | D | B800 (mT) A | B800 (mT) B |
|---|---|---|---|---|---|---|---|
| 650 | 22 | 120 | 0 | 0 | 18 | 1610 | 1520 |
| 750 | 44 | 130 | 10 | 0 | 21 | 1905 | 1580 |
| 850 | 92 | 180 | 60 | 10 | 20 | 1920 | 1930 |
| 950 | 75 | 230 | 100 | 30 | 24 | 1940 | 1920 |
| 1000 | 54 | 240 | 120 | 30 | 20 | 1925 | 1930 |

TABLE 4

(intermediate nitriding power)

| Nitriding temp. ° C. | $N_i$ | AlN | $AlN_n$ | $N_c$ | D | B800 (mT) A | B800 (mT) B |
|---|---|---|---|---|---|---|---|
| 650 | 65 | 120 | 0 | 0 | 19 | 1870 | 1580 |
| 750 | 152 | 140 | 20 | 10 | 20 | 1910 | 1720 |
| 850 | 237 | 210 | 90 | 30 | 18 | 1905 | 1920 |
| 950 | 155 | 290 | 170 | 50 | 24 | 1920 | 1930 |
| 1000 | 119 | 300 | 180 | 55 | 28 | 1935 | 1930 |

TABLE 5

(high nitriding power)

| Nitriding temp. ° C. | $N_i$ | AlN | $AlN_n$ | $N_c$ | D | B800 (mT) A | B800 (mT) B |
|---|---|---|---|---|---|---|---|
| 650 | 115 | 120 | 0 | 0 | 18 | 1880 | 1660 |
| 750 | 284 | 150 | 30 | 20 | 19 | 1870 | 1805 |
| 850 | 395 | 230 | 110 | 40 | 18 | 1890 | 1930 |
| 950 | 255 | 310 | 190 | 60 | 22 | 1920 | 1935 |
| 1000 | 195 | 310 | 190 | 70 | 25 | 1925 | 1930 |

From the tables shown above, it can be clearly noticed that, operating according to the present invention, it is possible: (a) to obtain an optimal dimension of the primary grain for further control of the secondary crystallisation, (b) to achieve a good nitrogen penetration into in the central part of the sheet, (c) to obtain quickly, in continuous annealing, the precipitation of aluminum nitride during the nitriding step; this latter fact is proved by the good results obtained when nitriding at high temperature and further operating according to cycle B.

EXAMPLE 3

Steel slabs (comprising Si 3.2% by weight, C 320 ppm, Als 290 ppm, N 80 ppm, Mn 1300 ppm, S 80 ppm) were produced by continuous casting, and further heated up to 1300° C. according to the present invention, hot- and cold-rolled to various thicknesses. The cold laminates were thereafter decarburized in continuous and nitrided according to the present invention at 970° C., by adjusting the nitriding power of the furnace atmosphere in order to let the steel absorb from 40 to 90 ppm of nitrogen. The strips were then box-annealed at 1200° C. with a heating rate of 40° C./hour.

The magnetic features [B800 in mT and core losses in W/kg at 1700 (P17) and 1500 mT (P15)] obtained in function of the thickness are reported in the following table 6:

TABLE 6

| Thickness (mm) | B800 | P17 | P15 |
|---|---|---|---|
| 0.35 | 1860 | 1.35 | 0.96 |
| 0.30 | 1872 | 1.21 | 0.82 |
| 0.27 | 1870 | 1.13 | 0.77 |
| 0.23 | 1876 | 0.97 | 0.56 |

EXAMPLE 4

A steel was produced (comprising Si 3.15% by weight, C 340 ppm, Als 270 ppm, N 80 ppm, Mn 1300 ppm, S 100 ppm, Cu 1000 ppm) and cold-transformed according to the present invention in a strip with thickness 0.29 mm. Process parameters were chosen in order to obtain an inhibition value (as defined in Example 1) comprised between 650 and 750 cm−1. This laminate was decarburized at 850 ° C. and nitrided, either at low temperature according to the conventional procedure (770° C. during 30 s), or according to the present invention (1000° C. during 30 s); in both cases a nitriding atmosphere was used consisting of nitrogen/hydrogen with addition of $NH_3$. The products underwent final annealing according to cycle B of Example 2. The obtained results are reported in Table 7, together with other analytical data (expressed in ppm), namely the total nitrogen ($N_t$), the total nitrogen in the sheet centre ($N_{tc}$), and the aluminum as nitride (AlN) after the nitriding step.

TABLE 7

| Nitriding temp. ° C. | $N_t$ | $N_{tc}$ | AlN | B800 (mT) | P17 W/kg | P15 W/kg |
|---|---|---|---|---|---|---|
| 700 | 282 | 125 | 180 | 1805 | 1.42 | 0.90 |
| 1000 | 264 | 188 | 280 | 1910 | 1.01 | 0.73 |

These strips were also analysed in order to determine the status of the precipitation at different depths according to the strip thickness.

As shown in FIG. 1, precipitates present in the decarburized strip contain sulfides, also mixed with nitrides and Al- and Si-based nitrides.

Figure 2A:
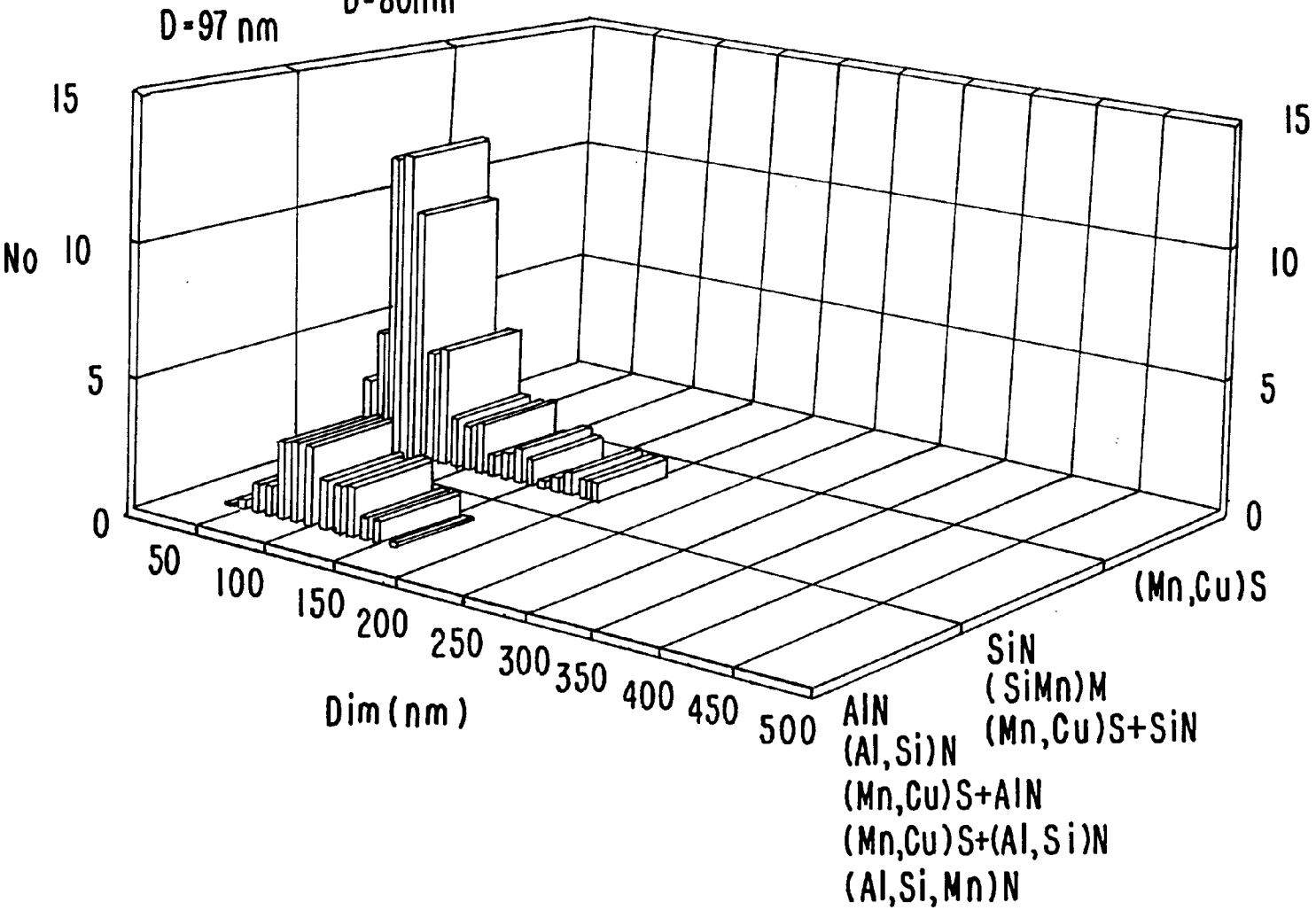
FIG. 2*a* is a diagram similar to that shown in FIG. 1, for a typical strip which was nitrided at low temperature according to known techniques, and referred to the situation of precipitates in the strip surface layers.
Figure 2B:
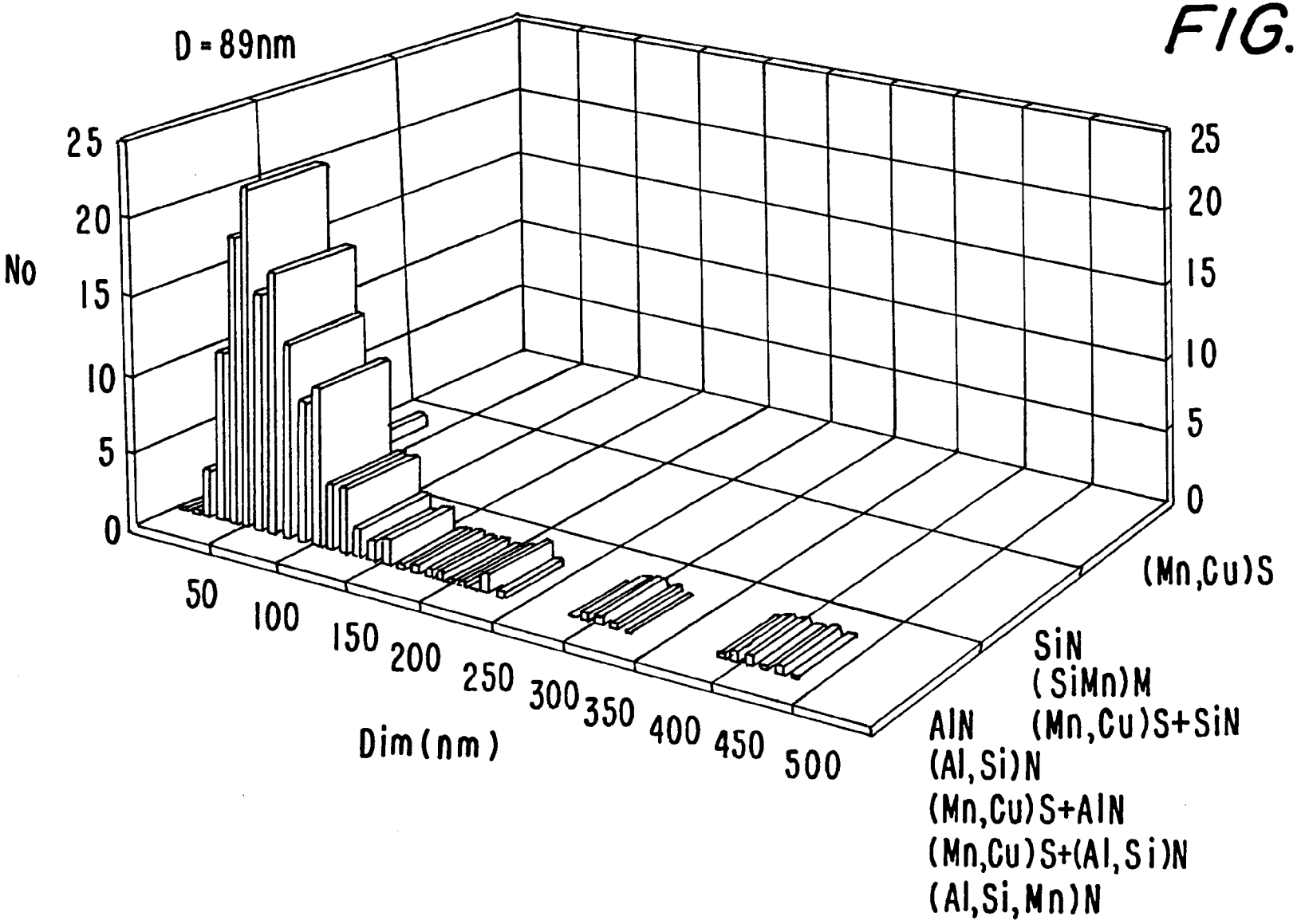
FIG. 2*b* is a diagram similar to that shown in FIG. 2*a,* relevant to a typical strip which was nitrided at 1000° C. according to the present invention.

In FIGS. 2–2*a,* 3–3*a,* 4–4*a* the different precipitates obtained after the nitriding step, respectively in the surface layers, at ¼ and ½ of the thickness, at 1000° C. (FIGS. 2*b,* 3*b* and 4*b*) and at 770° C. (FIGS. 2*a,* 3*a* and 4*a*), are compared.

As shown in the figures, in case of the high-temperature nitriding process according to the present invention, the formation of aluminum nitride or mixed aluminum and/or silicon and/or manganese nitrides is obtained along the whole strip thickness; these products are formed as new precipitates or as a coating of already existing sulfide precipitates, whereas silicon nitride is almost absent. Of course, in comparison with the strip of FIG. 1, the amount of particles and the relative dimensional distribution are different.

On the contrary. if the nitriding process is performed at low temperature (FIGS. 2*a,* 3*a* and 4*a*), the introduced nitrogen mainly precipitates, far from the strip centre, in the form of silicon- and silicon-manganese nitrides; these compounds, well known as being fairly unstable from the thermic point of view, must nevertheless undergo a long treatment in the temperature range from 700 to 900° C. in order to be dissolved and to release the nitrogen necessary for diffusion and reaction with aluminum.

Figure 3A:
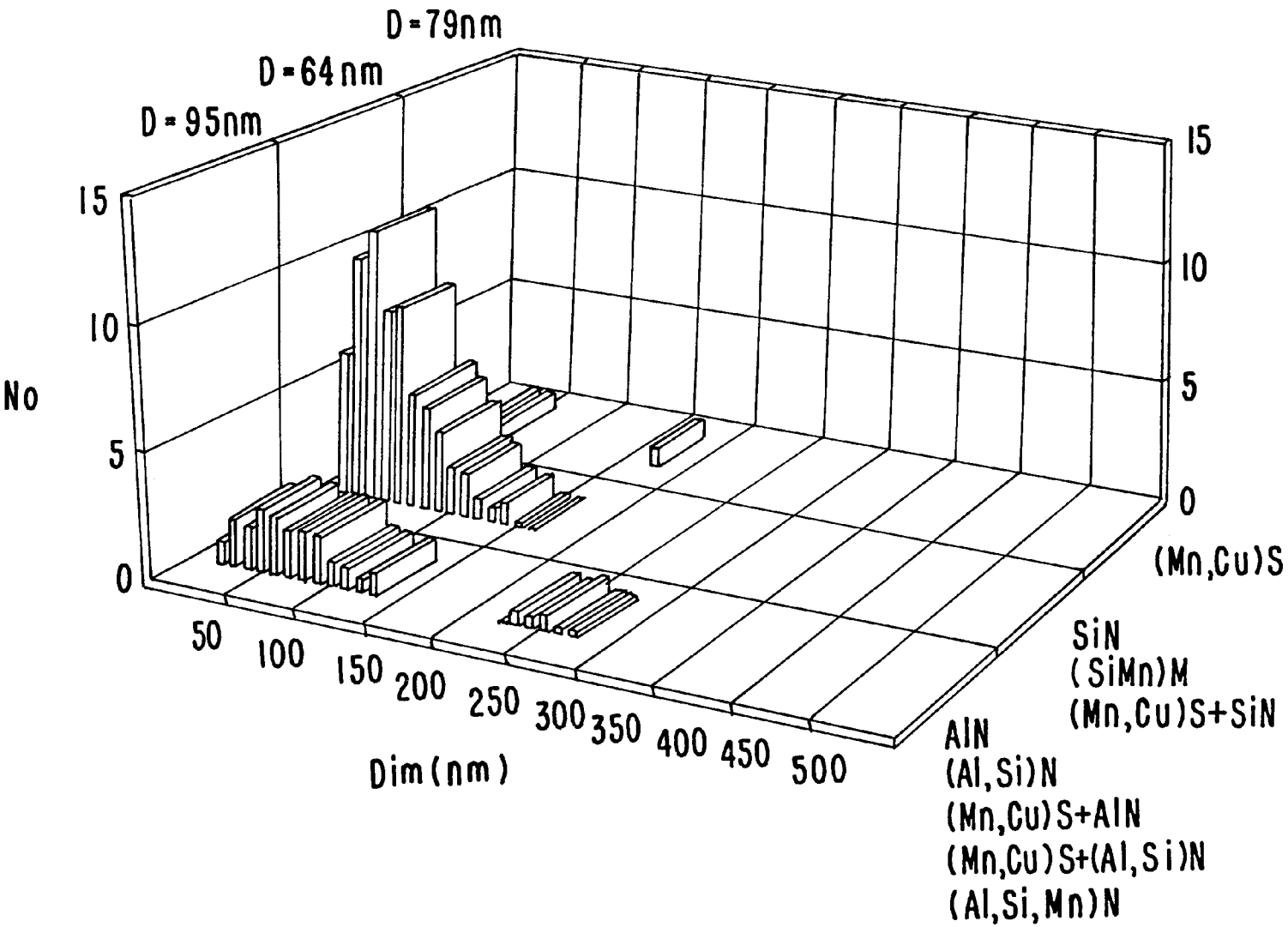
FIG. 3*a* is a diagram similar to that of FIG. 2*a,* relevant to a typical strip which was nitrided at low temperature according to known techniques, and referred to the situation of precipitates at ¼ of the sheet thickness.
Figure 3B:
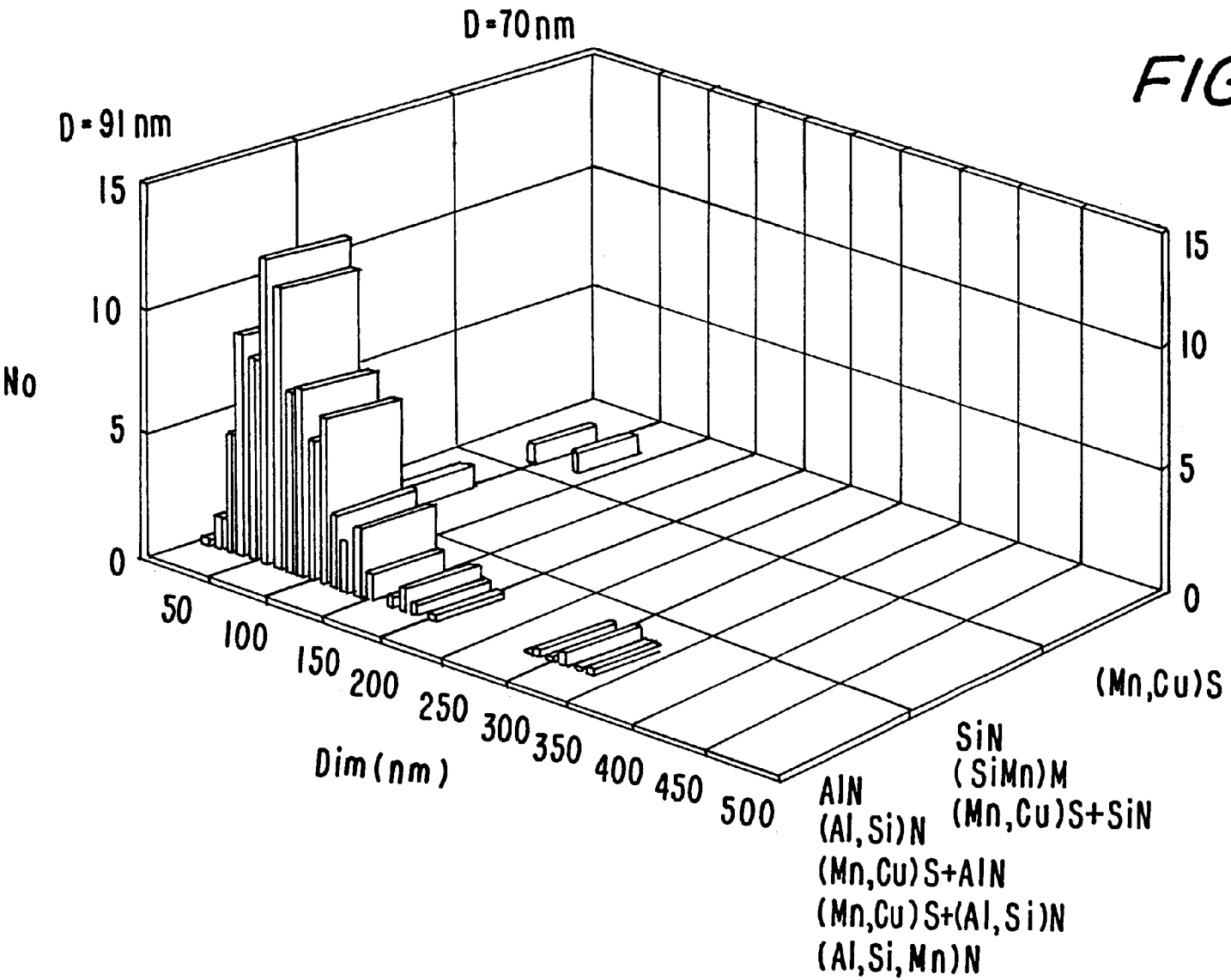
FIG. 3*b* is a diagram similar to that shown in FIG. 3*a,* relevant to a typical strip which was nitrided at 1000° C. according to the present invention.
Figure 4A:
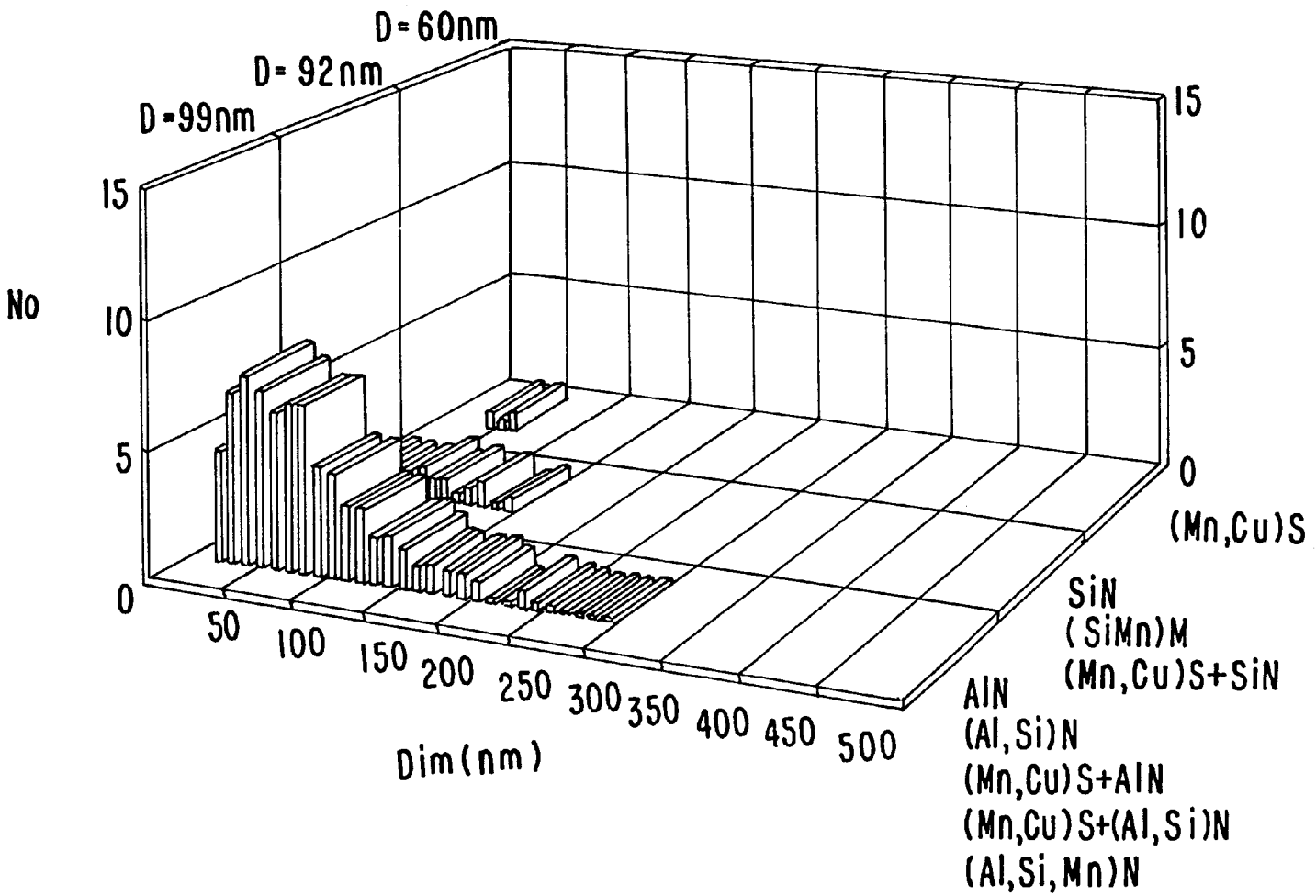
FIG. 4*a* is a diagram, similar to that of FIG. 2*a,* relevant to a typical strip which was nitrided at low temperature according to known techniques, and referred to the situation of precipitates at ½ of the sheet thickness.
Figure 4B:
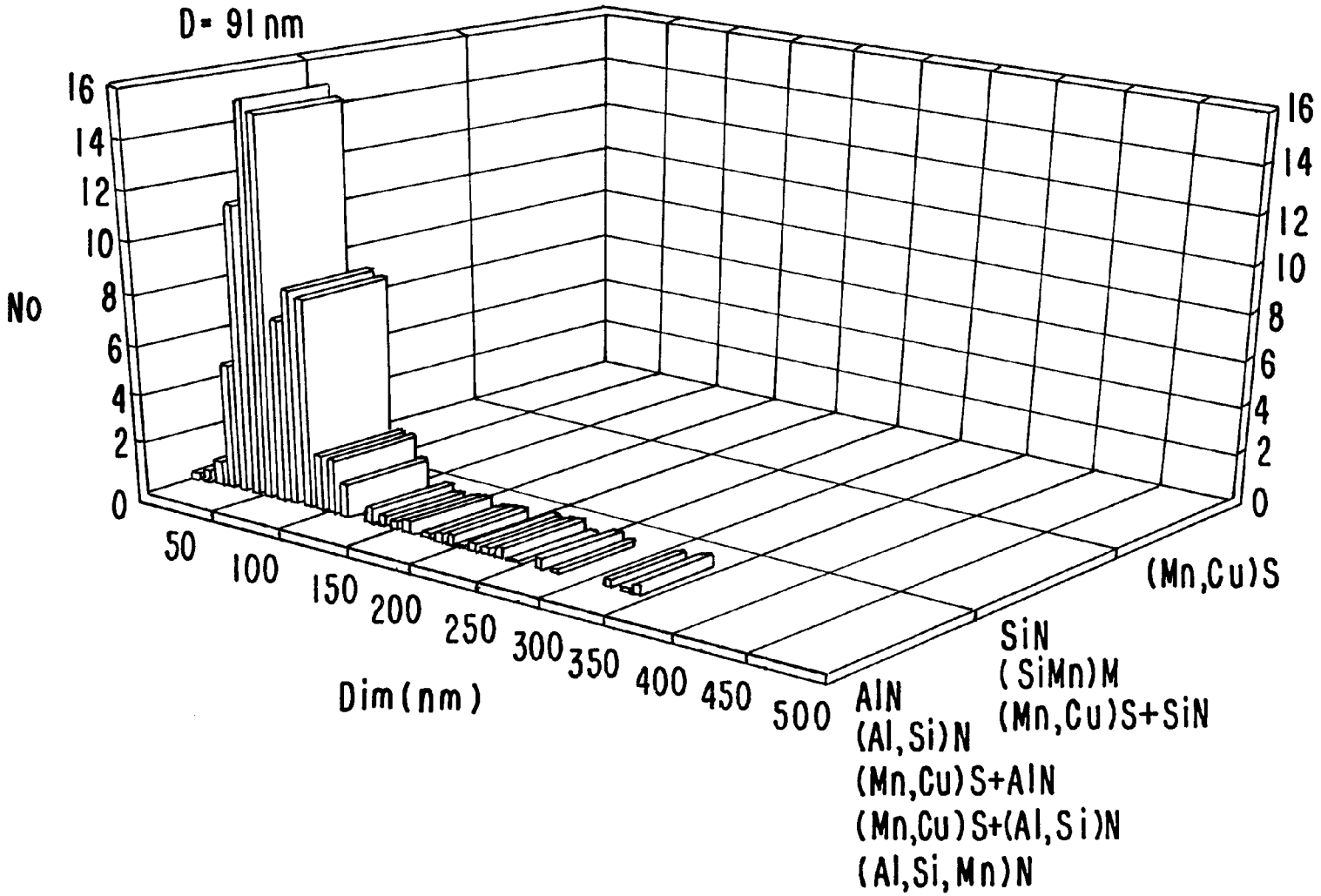
FIG. 4*b* is a diagram similar to that shown in FIG. 4*a,* relevant to a typical strip which was nitrided at 1000° C. according to the present invention.
Figure 5A:
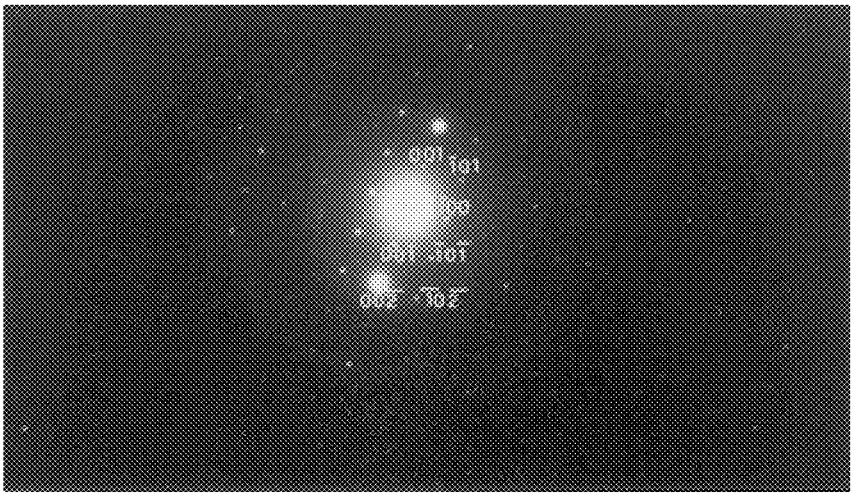
FIG. 5 shows: (i) in 5*b* the typical aspect and dimensions of the precipitates obtained according to the known nitriding process of silicon steel strips for magnetic purposes; (ii) in 5*a* the electronic diffraction pattern relative to FIG. 5*b;* (iii) in 5*c* the EDS spectrum and the concentration of the metallic elements of the precipitates of FIG. 5*b;*
In FIGS. 5*c* and 6*c,* the copper peak is relevant to the support used for the replication.
Figure 5B:
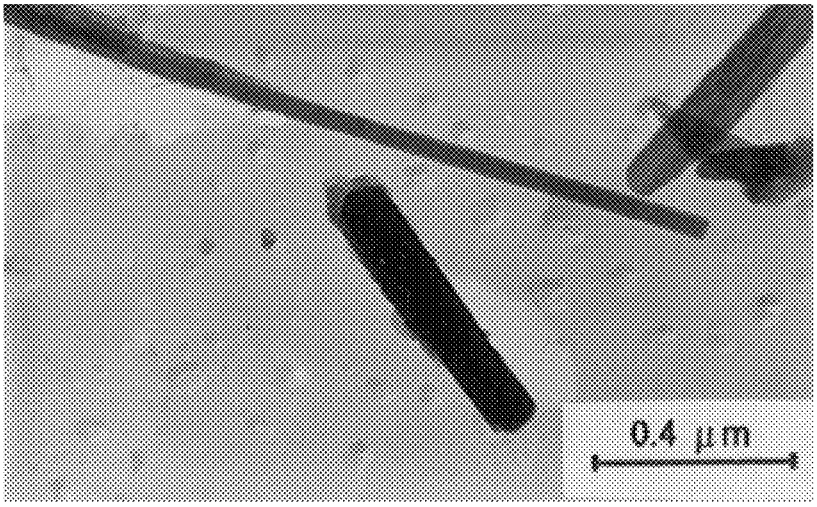
Figure 5C:
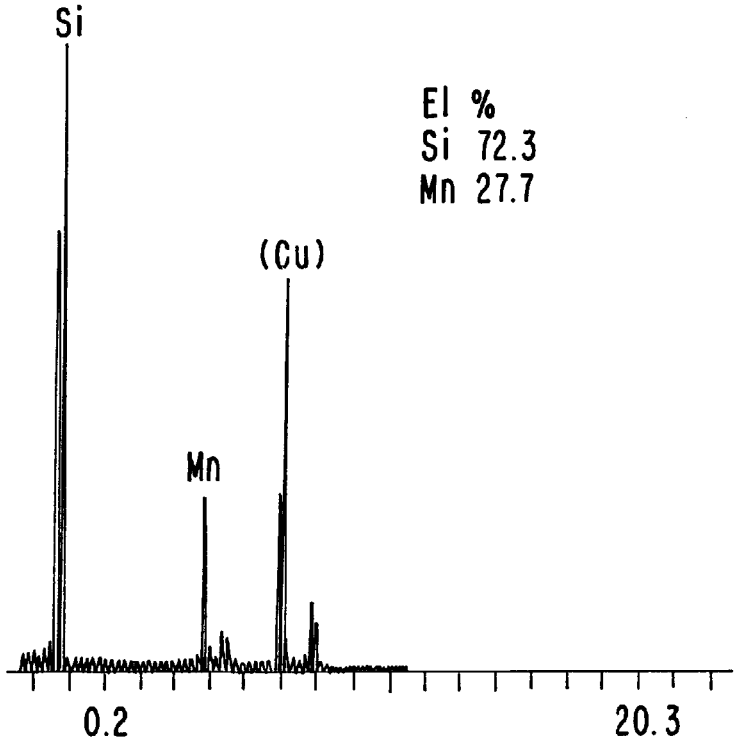
Figure 6C:
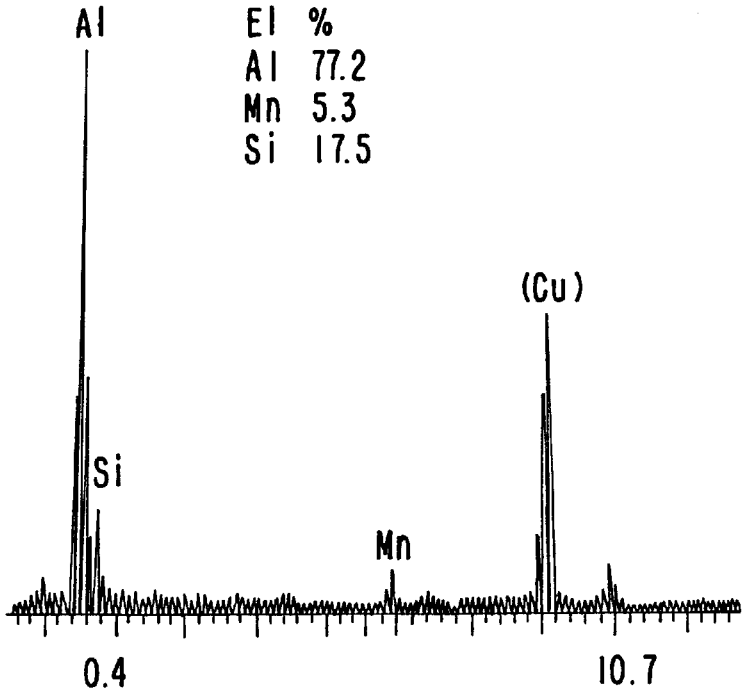
Figure 6A:
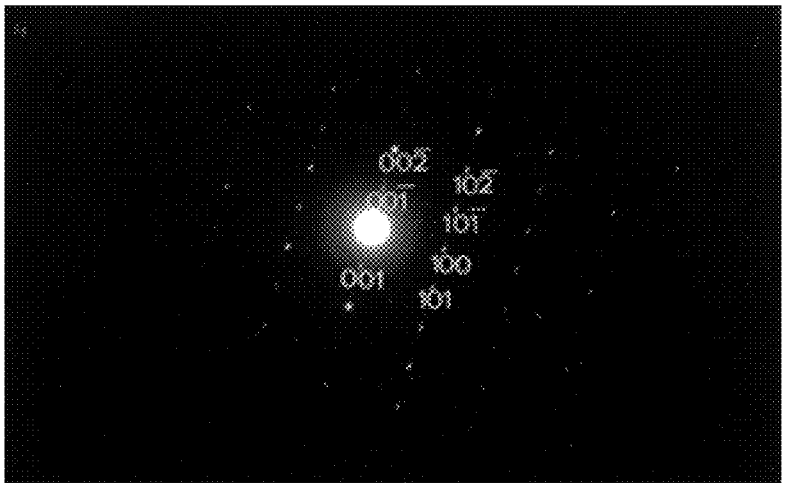
FIG. 6 is analogue to FIG. 5, but relevant to precipitates obtained according to the present invention.
Figure 6B:
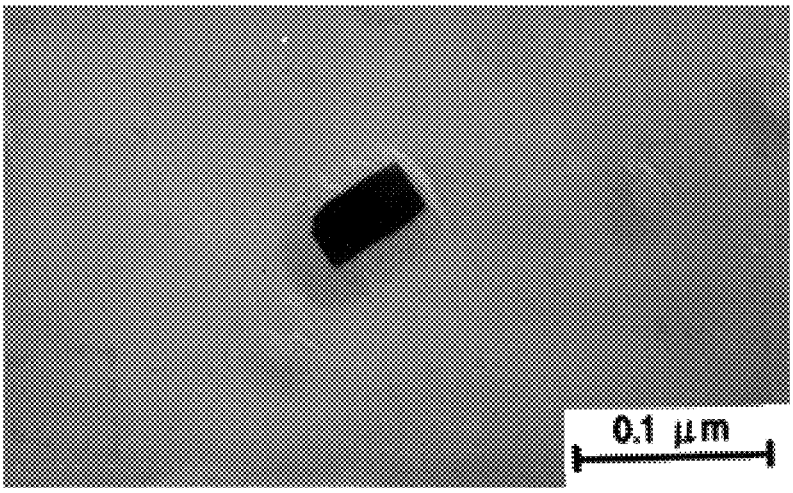

FIGS. 5 and 6, already described in the preceding paragraphs, confirm, with analytical and diffraction data, the conclusions presented above with respect to FIGS. 2 to 4; in particular, the electronic diffraction images confirm, for the product treated at low temperature, that the precipitates have crystallographic structure of the SiN3 type, with hcp a=0.5542 nm, C=0.496 nm, whereas in the case of the product treated at 1000° C. according to the present invention, the diffraction indicates a precipitate structure of the AlN type, with hcp a=0.311 nm, c=0.499 nm. Furthermore, the light-field images of FIGS. 5*b* and 6*b* clearly show the different structure and dimensions of the precipitates obtained according the known technique and according to the present invention.

What is claimed is:

1. In a process for the treatment of grain oriented silicon steel wherein said silicon steel is subjected to the steps of continuous casting, hot-rolling and cold-rolling to form a cold-rolled steel which is then subjected to a continuous annealing to effect a primary recrystallization annealing and optionally carrying out decarburization before coating said cold-rolled steel with an annealing separator and annealing to effect a secondary recrystallization, the improvement comprising:

(i) first, hot-rolling the silicon steel under conditions which cause the inhibition level (Iz) necessary to control grain growth, calculated according to the formula:

$$Iz=1.91\ Fv/r$$

where Fv is the volumetric fraction of the useful precipitates and r is the mean radius of said useful precipitates, to be comprised between 400 and 1300 $cm^{-1}$;

(ii) second, cold rolling the product of step (i);

(iii) third, performing said primary recrystallization annealing continuously between 800 and 950° C., in a wet nitroqen-hydrogen atmosphere to produce a primary recrystallized strip; and then continuously nitriding the primary recrystallized strip at a temperature between 850 and 1050° C. for a time between 5 and 120 seconds, in a wet nitriding atmosphere comprising ammonia at a level of from 1 to 35 standard liters per kg. of strip and from 0.5 to 100 $g/m^3$ of water vapor and (iv) box annealing the product of step (iii) under standard conditions.

2. Process according to claim 1, wherein said inhibition level Iz is obtained by performing an equalizing thermic treatment at a temperature comprised between 1100 and 1320° C., onto the continuously cast steel.

3. Process according to claim 1, wherein said thermic treatment is performed at a temperature comprised between 1270 and 1310° C.

4. Process according to claim 1 wherein the nitriding atmosphere contains $NH_3$, in an amount comprised between 1 and 9 normal liters per kg of treated strip.

5. Process according to claim 1, wherein the nitriding atmosphere contains steam in an amount comprised between 0.5 and 100 $gm/m^3$.

6. Process according to claim 1, wherein the primary recrystallization annealing temperature is comprised between 830° C. and 880° C., whereas the nitriding annealing is performed at a temperature equal to or higher than 950° C.

7. Process according to claim 1 wherein the content of aluminum in the steel is comprised between 150 and 450 ppm.

8. Process according to claim 1, wherein the strip heating from 700° C. to 1200° C. during the box annealing treatment, is performed within a time comprised between 2 and 10 hours.

9. Process according to claim 8, wherein the heating time of the strip from 700° C. to 1200° C. is lower than 4 hours.

10. A process for the treatment of grain oriented silicon steel according to claim 1 wherein an annealing treatment is carried out between steps (i) and (ii).

* * * * *